United States Patent [19]

Revett

[11] Patent Number: 4,541,487

[45] Date of Patent: Sep. 17, 1985

[54] WELL PERFORATING METHODS

[75] Inventor: Lowell W. Revett, LaFayette, La.

[73] Assignee: Halliburton Company, Duncan, Okla.

[21] Appl. No.: 577,438

[22] Filed: Feb. 6, 1984

[51] Int. Cl.[4] ..... E21B 43/117

[52] U.S. Cl. ..... 166/297; 166/280

[58] Field of Search ..... 166/297, 298, 299, 305 R, 166/55, 55.1, 280, 308; 175/4.51, 4.55, 4.57, 4.6

[56] References Cited

U.S. PATENT DOCUMENTS

| | | | |
|---|---|---|---|
| 2,766,828 | 10/1956 | Rachford, Jr. | 166/297 X |
| 2,805,722 | 9/1957 | Morgan et al. | 166/297 |
| 2,881,837 | 4/1959 | Staudt | 166/280 |
| 2,894,584 | 7/1959 | Birdwell et al. | 166/297 |

*Primary Examiner*—Stephen J. Novosad
*Assistant Examiner*—Thuy M. Bui
*Attorney, Agent, or Firm*—William J. Beard

[57] ABSTRACT

A well completion method comprising suspending NaCl crystals in the interval of the well bore to be perforated where the NaCl crystals are sized to bridge the perforations when the hydraulic pressure in the well bore exceeds the hydraulic pressure in the earth formation. The perforator is arranged to produce penetrations in the well bore in a radial pattern about the circumference of the well bore so as to effectively penetrate the entire circumference over a short interval. This enhances the perforation of vertical fractures in the earth formations.

7 Claims, 3 Drawing Figures

WELL PERFORATING METHODS

This application is a substitute for application Ser. No. 282,195 filed July 10, 1981.

FIELD OF THE INVENTION

This invention relates to well perforating methods for oil and gas wells, and more particularly, to perforating techniques for obtaining perforations into existing vertical fractures without well damage so that the formations can be produced via the perforated fractures without requiring hydraulic or chemical stimulation.

BACKGROUND OF THE INVENTION

In the completion of oil well, a well casing traverses the earth formations and perforations are provided at production levels so that oil or gas from low permeability oil or gas formations may be produced through existing fractures in the formations via the perforations. In many instances, existing vertical fracture may be utilized for production by intercepting these fractures with suitably spaced perforations about the circumference of the well casing. In the drilling of a well, a well control fluid called a "drilling mud" is commonly used to control the well by having a hydraulic pressure greater than the pressure of the fluids in the earth formations. If the pressure of the mud is significantly higher than the pressure in the formations, then fluid from the mud can enter into the earth formations and particles in the mud system tend to block existing vertical features in the formation.

In a cased well completion, it is necessary to produce the formations through the perforations. With present perforating techniques, it is extremely problematical whether or not a given perforation will intersect a natural vertical fracture. Where the fracture is at an angle to the vertical it is even more difficult to intersect the fracture by the perforation.

THE PRESENT INVENTION

The present invention is concerned with the placement of perforations about the circumference of the well casing in such a manner that the likelihood of intersecting a vertical or inclined fracture is more possible than not. In addition the perforations are produced while the perforating interval contains a suspension of salt crystals which provide a nondestructive bridging effect on the perforations. The formation thus is not subject to damage from the control fluid for the perforating process and the well may be produced without any special treatment.

IN THE DRAWINGS

DESCRIPTION OF THE PRESENT INVENTION

Figure 1:
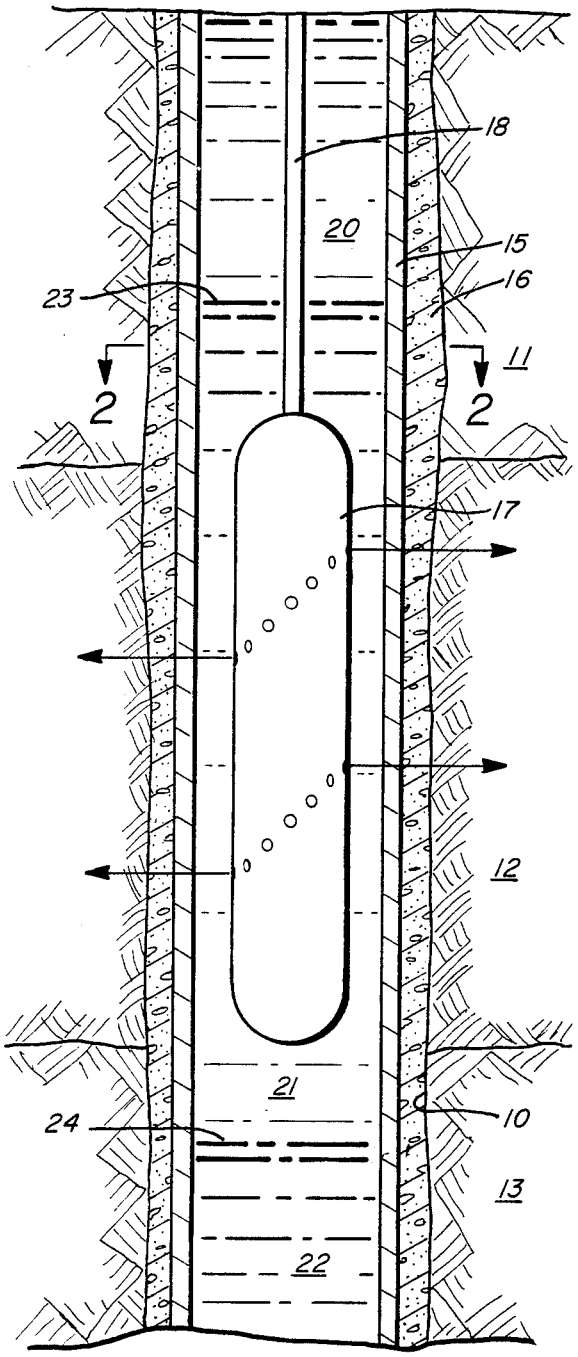
FIG. 1 is a schematic representation of a well bore to illustrate the application of the present invention.

Referring now to FIG. 1, a borehole 10 traverses earth formations 11, 12 and 13 where it is desired to produce from the earth formations 12. The borehole 10 receives a casing 15 which is cemented in place by an annulus of cement 16. The perforating apparatus 17 is adapted to produce perforations over substantially the entire circumference of a casing and is suspended in the well bore by an electrical armoured cable 18. In the present invention it is contemplated that the 20 type of perforating apparatus would have perforating means over a range of our perforating interval from one and one-half feet to approximately fifteen feet with a perforation density of not more than four perforations per foot. The apparatus is typically sized at three and one-eighth inch, four inch and five inch diameters.

Figure 2:
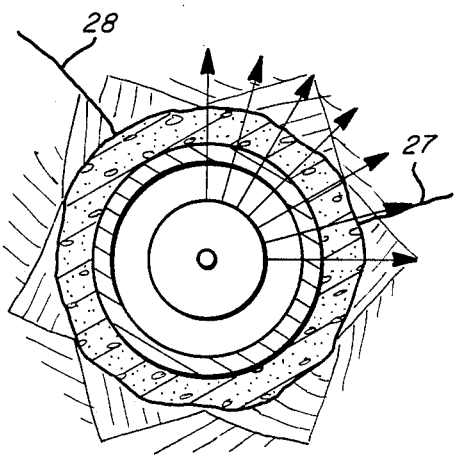
FIG. 2 is a view in cross section taken along line 2—2 of FIG. 1.

As illustrated in FIG. 1, each of the perforating means which produce the perforations are arranged in a spiral disposition about the length of the apparatus and the angular azimuthal phase difference between adjacent perforating means is 15°. Thus, as illustrated in FIG. 2, over an interval of the pipe which is perforated, an effective 360° penetration coverage of the casing is obtained. The 360° coverage is obtained by virtue of 15° angular displacement of the perforating means with respect to the vertical axis of the apparatus. The spiral of the perforating means is illustrated in a clockwise direction by the arrow but may, of course, be in a counterclockwise direction. If multiple perforations at the same location or depth in a well bore are desired by the use of separate apparatus on two trips in the well bore, then the use of oppositely spiraled perforating apparatus would avoid the likelihood of overlap of the perforations in the well bore.

For further reference to details of a perforator means, reference may be made to my co-pending patent application entitled "Spiral Gun Apparatus" which was filed on the same day herewith and was assigned Ser. No. 282.555.

In the operation of the present invention, it is necessary to spot or locate in the casing a column of fluid which consists of an upper fluid 20, a perforating fluid 21 and a lower fluid 22. The separation between fluids is illustrated by dashed lines 23 and 24. The perforating fluid 21 is designed to straddle the earth formation zone 12 which is to be perforated. The perforating fluid 21 contemplated for use by the present invention is a suspension of differently sized crystals such as NaCl crystals. Crystals of KCl or $CaCl_2$ may also be used. The particle size, for example, can be a mixture between 10 and 120 microns. A "coarse" size can be between 100 and 1100 microns while an "extra course" size can be between 120 and 10,000 microns. Additives may be used as temporary bridging agents for large size openings or for increasing density without affecting the salt crystals in solution.

The upper and lower liquids 20 and 22 preferably are salt water or brine concentrations to prevent the dispersion of the fluid 21. The perforating gun 17 preferably has 24 perforating means in a vertical space of six feet with an azimuthal spacing of shots at approximately 15°. This translates to a radial distance of 5.759" between perforations at a distance of 20" from a 4" diameter gun.

With the gun 17 and NaCl fluid suspension 21 in position, the perforations will be in radial directions as illustrated in FIG. 2. With hydraulic pressure greater in the pressure than in the earth formation 12, the fluids will enter the formation 12 and the NaCl crystals will bridge over and plug the perforations. It will be appreciated that the plugging of the perforations is accomplished without adversely affecting the earth formations as the salt is dissolvable and non-destructive to the formation. Thus, when it is desired to complete the well it is only necessary to set the production packer and produce the well.

Figure 3:
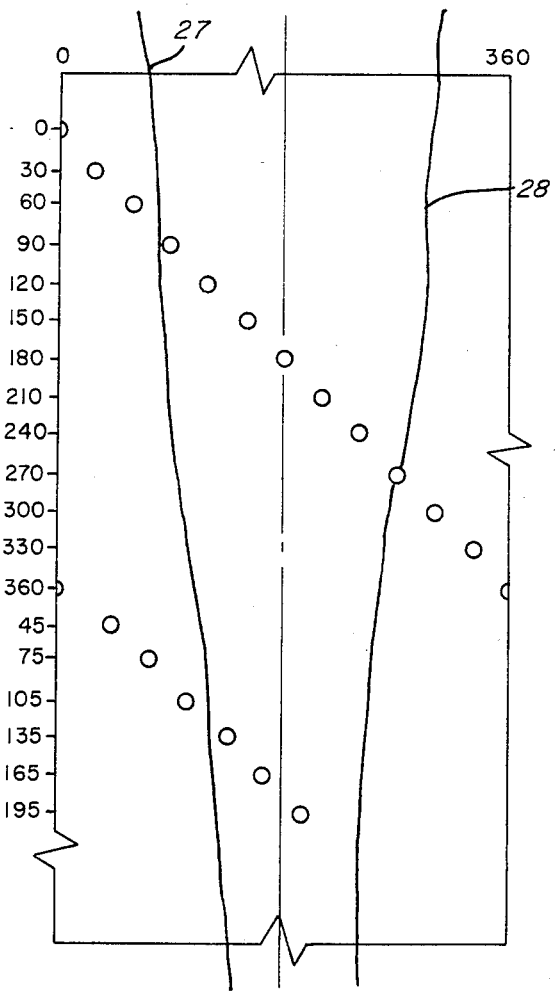
FIG. 3 is a plan view of a casing with perforations extended over a vertically fractured earth formation.

In FIGS. 2 and 3, vertical fractures 27 and 28 through the earth formation 12 are illustrated. In FIG. 3 the interval of casing 15 which is perforated is illustrated in a plane. As shown in FIGS. 2 and 3, the perforations are effectively spaced at 15° from one another over a circumferential span of the casing. The vertical fractures 27 and 28 over a span of 6 feet are more likely than not to be perforated which enhances flow of fluids.

I claim:

1. A method for increasing the probability of perforating existing vertical fractures outside well casing in a cased well borehole in earth formations traversed by a well bore comprising:

disposing a suspension of NaCl crystals in a fluid over an interval of a well bore where it is desired to perforate the surrounding earth formations, said crystals being sized to bridge over a perforation;

disposing perforating means in said interval where said perforating means are arranged, upon activation, to produce penetrations in the circumference of a cased well bore along a vertical section of the cased well, said perforating means being spaced longitudinally with respect to one another with respect to said vertical axis and being azimuthally oriented with respect to one another to provide penetrations at angles of approximately 15° with respect to said vertical axis; and maintaining the hydraulic pressure of said fluid in said interval greater than the expected pressure of the earth formations to be perforated.

2. The method as set forth in claim 1 wherein said perforating means includes a first set of perforating devices disposed spirally along the length of said tool body at an angular spacing of 30° with respect to one another and a second set of perforating devices disposed spirally along the length of said tool at an angular spacing of 30° with respect to one another and wherein said first and second sets of perforating devices are offset from each other by an angular spacing of 15°.

3. The method as set forth in claim 1 wherein said NaCl crystals have a particle size ranging between 10 and 120 microns.

4. The method as set forth in claim 1 wherein said NaCl crystals have a particle size ranging between 100 and 1100 microns.

5. The method as set forth in claim 1 wherein said NaCl crystals have a particle size ranging between 120 and 10,000 microns.

6. The method as set forth in claim 1 wherein said perforating means perforates over an interval of not more than fifteen feet.

7. The method as set forth in claim 1 wherein the suspension of NaCl crystals is contained between fluids having a high salt content.

* * * * *